US008833498B2

(12) United States Patent
Charnesky et al.

(10) Patent No.: US 8,833,498 B2
(45) Date of Patent: Sep. 16, 2014

(54) SHUTTER CONTROL DURING AMBIENT TEMPERATURE WARM-UP ACROSS A FREEZING POINT

(75) Inventors: Scott P. Charnesky, Birmingham, MI (US); Terry C Bishop, Chesaning, MI (US); David A Schoener, Grand Blanc, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 382 days.

(21) Appl. No.: 12/910,197

(22) Filed: Oct. 22, 2010

(65) Prior Publication Data

US 2012/0100791 A1 Apr. 26, 2012

(51) Int. Cl.

| | |
|---|---|
| ***B60K 11/00*** | (2006.01) |
| ***B60J 1/00*** | (2006.01) |
| ***F01P 11/20*** | (2006.01) |
| ***F01P 7/10*** | (2006.01) |

(52) U.S. Cl.

CPC ..... *F01P 7/10* (2013.01); *F01P 2025/32* (2013.01); *F01P 11/20* (2013.01); *F01P 2025/13* (2013.01)

USPC ..... 180/68.1; 296/180.5

(58) Field of Classification Search

USPC ..... 180/68.1, 68.2, 68.4, 68.6; 123/41.02–41.07; 415/121.2, 220, 222; 137/601.09, 601.14; 165/98; 296/50, 296/57.1, 180.5; 160/DIG. 1

See application file for complete search history.

(56) References Cited

U.S. PATENT DOCUMENTS

| | | | | |
|---|---|---|---|---|
| 2,261,584 | A * | 11/1941 | Knowlton et al. | 165/271 |
| 4,476,820 | A * | 10/1984 | Nixon | 123/41.05 |
| 4,924,826 | A * | 5/1990 | Vinson | 123/41.05 |
| 5,269,264 | A * | 12/1993 | Weinhold | 123/41.05 |
| 5,566,745 | A * | 10/1996 | Hill et al. | 165/299 |
| 5,669,311 | A * | 9/1997 | Hill et al. | 105/62.2 |
| 6,142,108 | A * | 11/2000 | Blichmann | 123/41.05 |
| 6,588,380 | B2 * | 7/2003 | Ries-Mueller | 123/41.05 |
| 6,759,643 | B2 | 7/2004 | Su et al. | |
| 6,918,456 | B2 * | 7/2005 | Dennison et al. | 180/68.1 |
| 7,498,926 | B2 * | 3/2009 | Browne et al. | 180/68.1 |
| 7,766,111 | B2 * | 8/2010 | Guilfoyle et al. | 180/68.1 |
| 7,784,576 | B2 * | 8/2010 | Guilfoyle et al. | 180/68.1 |
| 8,020,536 | B2 * | 9/2011 | Kardos | 123/542 |
| 8,025,045 | B2 * | 9/2011 | Pettersson et al. | 123/542 |
| 8,161,919 | B2 * | 4/2012 | Klotz et al. | 123/41.04 |
| 8,311,708 | B2 * | 11/2012 | Kerns | 701/49 |
| 8,517,130 | B2 * | 8/2013 | Sakai | 180/68.1 |
| 8,689,917 | B2 * | 4/2014 | Miesterfeld et al. | 180/68.1 |
| 8,708,078 | B2 * | 4/2014 | Charnesky et al. | 180/68.4 |

FOREIGN PATENT DOCUMENTS

| | | | |
|---|---|---|---|
| CN | 1959052 | A | 5/2007 |

(Continued)

*Primary Examiner* — J. Allen Shriver, II
*Assistant Examiner* — James M Dolak
(74) *Attorney, Agent, or Firm* — Quinn Law Group, PLLC

(57) ABSTRACT

A method of controlling operation of an adjustable shutter adapted for varying an amount of airflow to cool a powertrain in a vehicle includes monitoring the ambient temperature. The method also includes sensing an increase in the ambient temperature up to a threshold temperature value. The method additionally includes changing a position of the shutter after a predetermined amount of time has elapsed following the increase in the ambient temperature up to the threshold temperature value. A vehicle using a controller to perform such a method is also provided.

9 Claims, 4 Drawing Sheets

(56) References Cited

FOREIGN PATENT DOCUMENTS

| | | | |
|---|---|---|---|
| CN | 102877764 | A | 1/2013 |
| DE | 3145506 | A1 | 5/1983 |
| DE | 10019419 | A1 | 10/2001 |
| DE | 112007001053 | T5 | 2/2009 |
| FR | 2904950 | A1 | 2/2008 |
| JP | 2001233038 | A | 8/2001 |
| TW | 200944397 | A | 11/2009 |

* cited by examiner

SHUTTER CONTROL DURING AMBIENT TEMPERATURE WARM-UP ACROSS A FREEZING POINT

TECHNICAL FIELD

The invention relates to shutter control during ambient temperature warm-up across a freezing point.

BACKGROUND

A shutter is typically a solid and stable covering for an opening. A shutter frequently consists of a frame and louvers or slats mounted within the frame.

Louvers may be fixed, i.e., having a permanently set angle with respect to the frame. Louvers may also be operable, i.e., having an angle that is adjustable with respect to the frame for permitting a desired amount of light, air, and/or liquid to pass from one side of the shutter to the other. Depending on the application and the construction of the frame, shutters can be mounted to fit within, or to overlap the opening. In addition to various functional purposes, particularly in architecture, shutters may also be employed for largely ornamental reasons.

In motor vehicles, a shutter may be employed to control and direct a stream of light and/or air to various vehicle compartments. Therefore, a shutter may be employed to enhance comfort of vehicle passengers, as well as for cooling a range of vehicle systems.

SUMMARY

A method of controlling operation of an adjustable shutter adapted for varying an amount of airflow to cool a powertrain in a vehicle includes monitoring the ambient temperature. The method also includes sensing an increase in the ambient temperature up to a threshold temperature value. The method additionally includes changing a position of the shutter after a predetermined amount of time has elapsed following the increase in the ambient temperature up to the threshold temperature value.

According to the method, the threshold temperature value may be above the freezing point. Additionally, the predetermined amount of time may be indicative of an amount of time needed to thaw ice on the shutter.

The method may also include monitoring a temperature of the powertrain, wherein the act of requesting the change in the position of the shutter may be additionally accomplished in response to an increase in the temperature of the powertrain.

According to the method, each of said monitoring the ambient temperature, sensing the increase in the ambient temperature, changing the position of the shutter after the predetermined amount of time, and monitoring the temperature of the powertrain may be accomplished by a controller.

The shutter may include a mechanism configured to select the position of the shutter between and inclusive of the fully opened and the fully closed positions in response to a command from the controller. In such a case, the act of changing the position of the shutter after the predetermined amount of time may be accomplished by one of delaying a command from the controller to the mechanism and delaying a response by the mechanism.

The powertrain may include an internal combustion engine and a fan adapted to draw the airflow through the shutter to cool the engine. Accordingly, the method may additionally include selectively turning the fan on and off and selecting the shutter positions between and inclusive of the fully-opened and the fully-closed by the controller according to a load on the engine.

The vehicle may include a heat exchanger and a fluid circulated through the heat exchanger such that the engine is cooled by the fluid, and a sensor configured to sense a temperature of the fluid. Accordingly, the method may further include cooling the engine by the fluid and sensing the temperature of the fluid by the sensor. Moreover, the method may include selecting the shutter position between and inclusive of the fully-opened and the fully-closed by the controller according to the sensed temperature of the fluid.

The method may additionally include monitoring the ambient temperature and selecting and locking a predetermined position for the shutter in response to the ambient temperature being below a predetermined value.

The shutter may be arranged one of integral to the grille opening and adjacent to the grille opening.

A vehicle using a controller to perform such a method is also disclosed.

The above features and advantages and other features and advantages of the present invention are readily apparent from the following detailed description of the best modes for carrying out the invention when taken in connection with the accompanying drawings.

DETAILED DESCRIPTION

Figure 1:
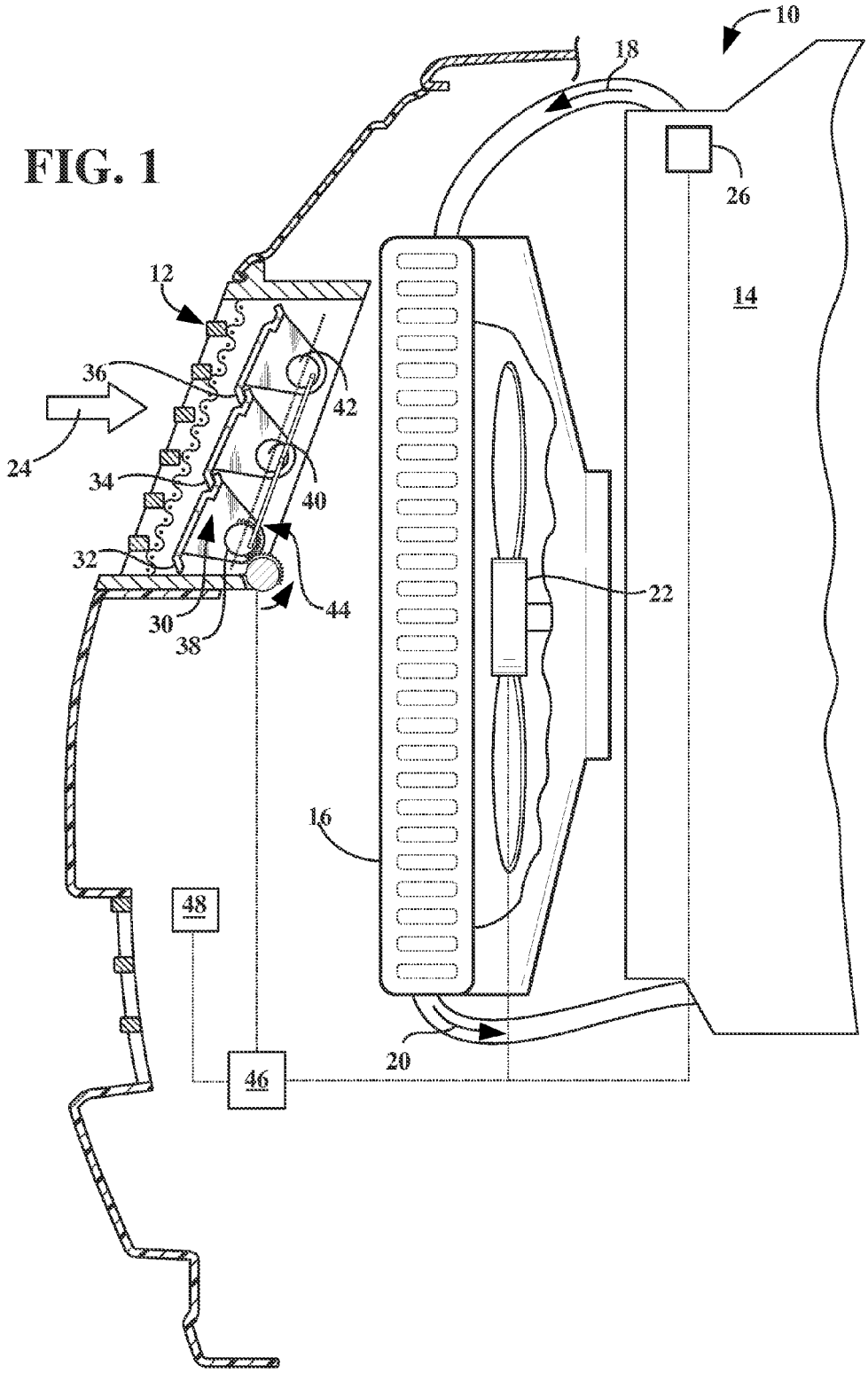
FIG. 1 is a partial side cross-sectional view of a vehicle having a shutter depicted in a fully closed state.
Figure 2:
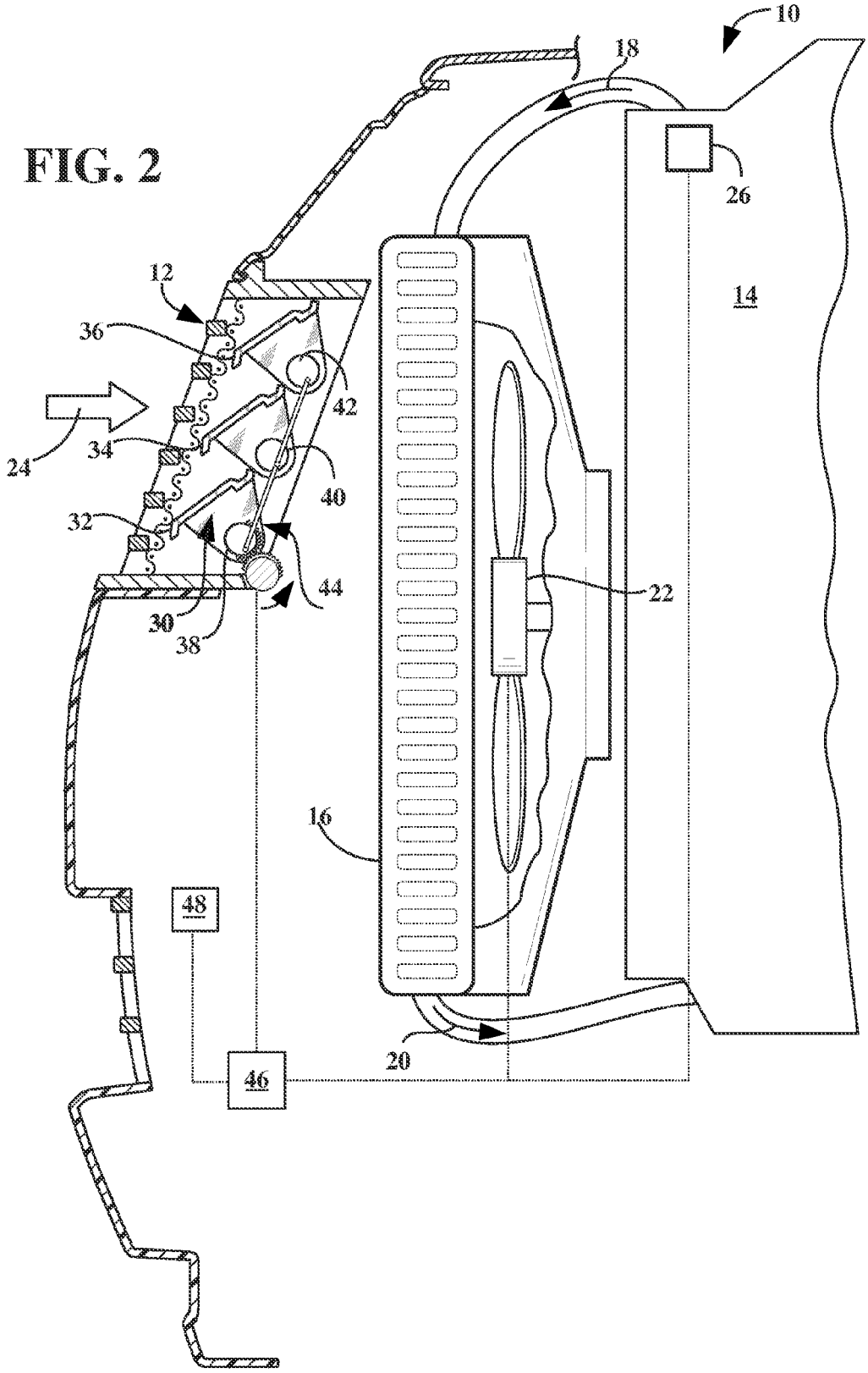
FIG. 2 is a partial side cross-sectional view of a vehicle having the shutter shown in FIG. 1, with the shutter depicted in an intermediate state.
Figure 3:
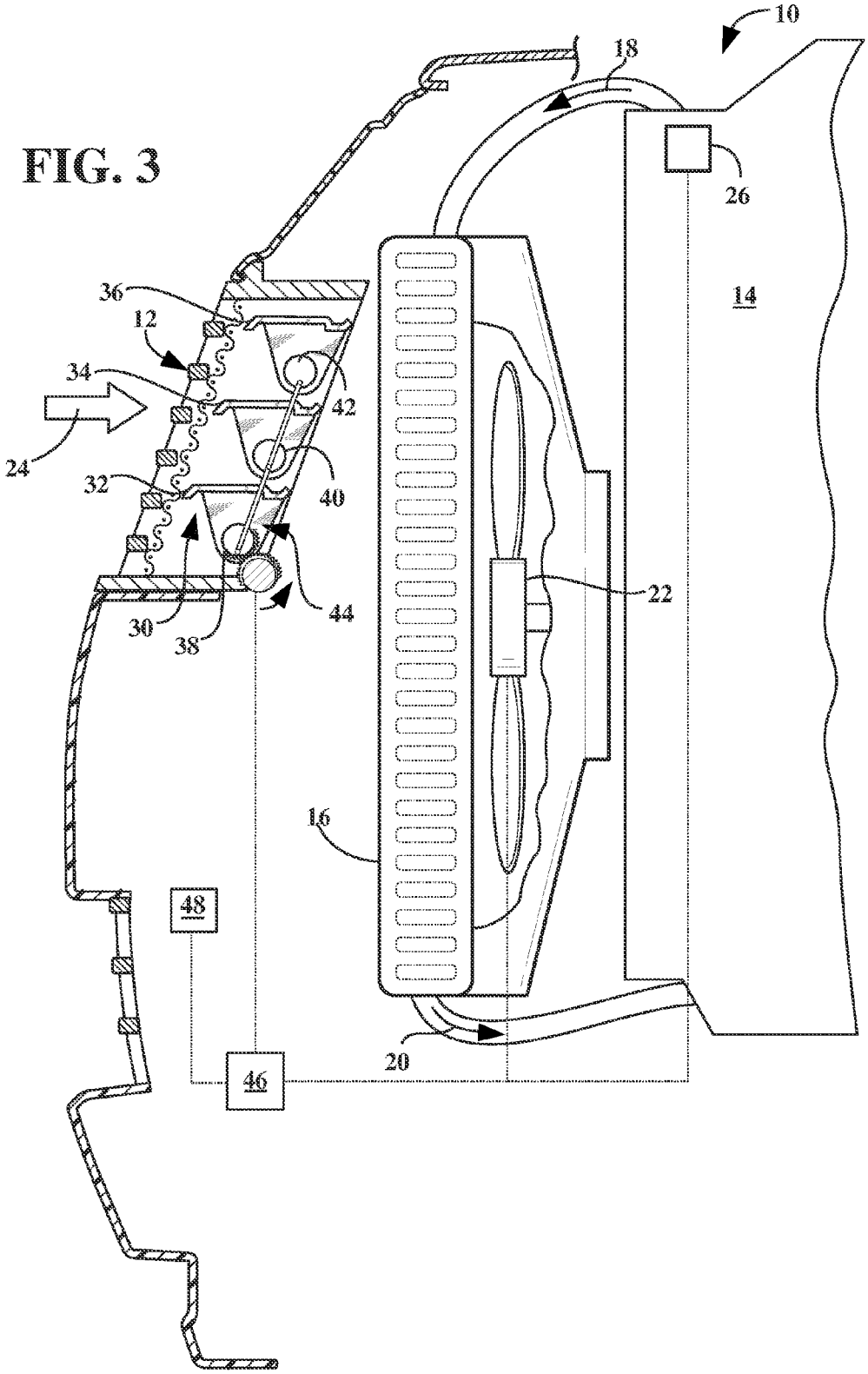
FIG. 3 is a partial side cross-sectional view of a vehicle having the shutter system shown in FIGS. 1 and 2, with the shutter depicted in a fully opened state.

Referring to the drawings, wherein like reference numbers refer to like components, FIGS. 1-3 show a partial side view of a vehicle 10. The vehicle 10 is shown to include a grille opening 12 typically covered with a mesh. The grille opening 12 is adapted for receiving ambient air. The vehicle 10 additionally includes a powertrain that is specifically represented by an internal combustion engine 14. The powertrain of the vehicle 10 may additionally include a transmission, and, if the vehicle is a hybrid type, one or more motor-generators, none of which is shown, but the existence of which can be appreciated by those skilled in the art. Efficiency of a vehicle powertrain is generally influenced by its design, as well as by the various loads the powertrain sees during its operation.

The vehicle 10 additionally includes an air-to-fluid heat exchanger 16, i.e., a radiator, for circulating a cooling fluid shown by arrows 18 and 20, such as water or a specially formulated coolant, though the engine 14 to remove heat from the engine. A high-temperature coolant entering the heat exchanger 16 is represented by the arrow 18, and a reduced-temperature coolant being returned to the engine is represented by the arrow 20. The heat exchanger 16 is positioned behind the grille opening 12 for protection of the heat exchanger from various road-, and air-borne debris. The heat exchanger 16 may also be positioned in any other location, such as behind a passenger compartment, if, for example, the vehicle has a rear or a mid-engine configuration, as understood by those skilled in the art.

As shown in FIGS. 1-3, a fan 22 is positioned in the vehicle 10, behind the heat exchanger 16, such that the heat exchanger 16 is positioned between the grille opening 12 and the fan. The fan 22 is capable of being selectively turned on and off based on the cooling needs of the engine 14. Depending on the road speed of the vehicle 10, the fan 22 is adapted to either generate or enhance a stream of air or airflow 24 through the grille opening 12, and toward and through the heat exchanger 16. Thus generated or enhanced through the action of the fan 22, the airflow 24 is passed through the heat exchanger 16 to remove heat from the high-temperature coolant 18 before the reduced-temperature coolant 20 is returned to the engine 14. The fan 22 may be driven either electrically, or mechanically, directly by engine 14. The vehicle 10 additionally includes a coolant sensor 26 configured to sense a temperature of the high-temperature coolant 18 as it exits the engine 14.

Because the fan 22 is driven by the engine 14, size of the fan is typically selected based on the smallest fan that in combination with the available grille opening 12 is sufficient to cool the engine during severe or high load conditions imposed on the vehicle 10. Typically, however, when the size of the grille opening 12 is tailored to such severe load conditions, the grille opening generates significant aerodynamic drag on the vehicle which causes a loss in operating efficiency of the engine 14. On the other hand, if the size of the grille opening 12 is chosen based on the aerodynamic and operating efficiency requirements at higher vehicle speeds, the size of the fan 22 that is required to generate sufficient airflow at high load conditions becomes so great, that the fan generates significant parasitic drag on the engine 14. Therefore, an adjustable or variable size for the grille opening 12 would permit the fan 22 to be sized for minimum parasitic drag on the engine 14, while being capable of satisfying the high vehicle load cooling requirements. At the same time, such an adjustable grille opening 12 would permit selection of a smaller fan that would further serve to increase the operating efficiency of the powertrain.

FIGS. 1-3 also depict a rotatable or adjustable shutter 30. The shutter 30 is secured in the vehicle 10 and is adapted to control the airflow 24 through the grille opening 12. As shown, the shutter 30 is positioned behind, and immediately adjacent to the grille opening 12 at the front of the vehicle 10. As shown, the shutter 30 is positioned between the grille opening 12 and the heat exchanger 16. The shutter 30 may also be incorporated into and be integral with the grille opening 12. The shutter 30 includes a plurality of louvers, herein shown as having three individual louver elements 32, 34, and 36, but the number of louvers may either be fewer or greater. Each louver 32, 34, and 36 is configured to rotate about a respective pivot axis 38, 40, and 42 during operation of the shutter 30, thereby effectively controlling the size of the grille opening 12. The shutter 30 is adapted to operate between and inclusive of a fully-closed position or state (as shown in FIG. 1), through an intermediate position (as shown in FIG. 2), and to a fully-opened position (as shown in FIG. 3). When the louver elements 32, 34, and 36 are in any of their open positions, the airflow 24 penetrates the plane of shutter 30 before coming into contact with the heat exchanger 16.

The shutter 30 also includes a mechanism 44 configured to select and lock a desired position for the shutter between and inclusive of fully-opened and fully-closed. The mechanism 44 is configured to cause the louvers 32-36 to rotate in tandem, i.e., substantially in unison, and permitting the shutter 30 to rotate into any of the available positions. The mechanism 44 may be adapted to select and lock either discrete intermediate position(s) of the louvers 32-36, or to infinitely vary position of the louvers between and inclusive of the fully-opened and fully-closed. The mechanism 44 acts to select the desired position for the shutter 30 when activated by any external means, as understood by those skilled in the art, such as an electric motor (not shown). The vehicle 10 also includes a controller 46, which may be an engine controller or a separate control unit, configured to regulate the mechanism 44 for selecting the desired position of the shutter 30. The controller 46 may also be configured to operate the fan 22, if the fan is electrically driven, and a thermostat (not shown) that is configured to regulate the circulation of coolant, as understood by those skilled in the art.

The controller 46 is programmed to regulate the mechanism 44 according to the load on the engine 14 and, correspondingly, to the temperature of the coolant sensed by the sensor 26. The temperature of the high-temperature coolant 18 is increased due to the heat produced by the engine 14 under load. As known by those skilled in the art, a load on the engine is typically dependent on operating conditions imposed on the vehicle 10, such as going up a hill and/or pulling a trailer. The load on the engine 14 generally drives up internal temperature of the engine, which in turn necessitates cooling of the engine for desired performance and reliability. Prior to exiting the engine 14, coolant is routed inside the engine in order to most effectively remove heat from critical engine components, such as bearings (not shown, but known by those skilled in the art). Typically, the coolant is continuously circulated by a fluid pump (not shown) between the engine 14 and the heat exchanger 16.

When the shutter 30 is fully-closed, as depicted in FIG. 1, the louvers 32-36 provide blockage of the airflow 24 at the grille opening 12. A fully-closed shutter 30 provides optimized aerodynamics for the vehicle 10 when engine cooling through the grille opening 12 is not required. The shutter 30 may also be regulated by the controller 46 to variably restrict access of the oncoming airflow 24 to the heat exchanger 16, by rotating the louvers 32-36 to an intermediate position, as shown in FIG. 2, where the louvers are partially closed. An appropriate intermediate position of the louvers 32-36 is selected by the controller 46 according to a programmed algorithm to thereby affect the desired cooling of the engine 14. When the shutter 30 is fully-opened, as shown in FIG. 3, each louver 32-36 is rotated to a position parallel to the airflow 24 seeking to penetrate the shutter system plane. Thus, a fully-opened shutter 30 is configured to permit a generally unfettered passage of such a stream of air through the louver plane of the shutter 30.

Ambient temperatures near and below freezing may present considerations for cooling of the powertrain in the vehicle 10. When the ambient temperature is below a predetermined value, i.e., near or below freezing, sufficient cooling of the engine 14 may be achieved with the grille opening 12 either in the partially restricted or in the fully blocked state. At the same time, the louvers 32-36 and the mechanism 44 may freeze and become jammed at such low temperatures. Therefore, in order to prevent jamming of the shutter 30 in some unwanted position, when the ambient temperature is below the predetermined value, an appropriate predetermined position of the shutter 30 may be selected and locked without regard to vehicle speed and load. The grille opening 12 may be placed in any position between and inclusive of the fully open and the fully restricted states via the predetermined position of the shutter 30 depending on the cooling requirements of the powertrain of the vehicle 10.

The predetermined locked position or a number of discrete locked positions of the shutter 30 that would still permit sufficient cooling of the powertrain near and below freezing ambient temperatures may be established empirically during testing and development of the vehicle 10. The controller 46 may be employed to monitor the ambient temperature via a temperature sensor 48 and regulate and lock the position of the shutter 30 via the mechanism 44 in response to the ambient temperature being below the predetermined value. While the predetermined locked position of the shutter 30 is that of fully-closed, the fan 22 may be turned off or maintained in the off position via the controller 46. On the other hand, if the predetermined locked position of the shutter 30 is that of non fully-closed, and depending on the vehicle load, the fan 22 may be turned on. Full control over the selectable positions of the shutter 30 may then be returned when the ambient temperature as sensed by the temperature sensor 48 again rises above the predetermined value, such as when a typical day progresses during the Autumn or Fall, and Spring seasons.

The ambient temperature as sensed by the temperature sensor 48 may also increase across a predetermined temperature range, such as from substantially near or below the freezing point to significantly above freezing, in a relatively brief period of time. For example, such a situation may develop during descent of the vehicle 10 from a significant elevation in the mountains to near sea level. The predetermined temperature range may, for example, cover from 1 degree below zero to 5 degrees above zero Celsius. The period of time during which the ambient temperature thus increases may be sufficiently brief, for example on the order of 15 minutes or less, such that any ice or frost that has formed on the louvers 32-36 and/or the mechanism 44 may not have sufficient opportunity to thaw or melt. In such a situation, the ice that may have formed on the louvers 32-36 and/or the mechanism 44 may impede the movement of these components the position of the shutter 30 is being changed, thus potentially causing damage to the shutter 30.

Accordingly, in order to manage such a relatively rapid increase in the ambient temperature, the position of the shutter 30 is changed in response to a sensed increase in the ambient temperature above the freezing point and up to a threshold temperature value, such as 4.5 degrees Celsius. Additionally, the controller 46 is programmed to change the position for the shutter 30 via the mechanism 44 after a predetermined amount of time has elapsed following the increase in the ambient temperature up to the threshold temperature value.

The predetermined amount of time is indicative of an amount of time needed to thaw ice on the shutter 30, for example on the order of 5-15 minutes for fast ambient warm up conditions and several hours for slow warm up conditions, such that unimpeded movement of the louvers 32-36 and the mechanism 44 may be restored. The predetermined amount of time needed to thaw ice on the shutter 30 may be established empirically during testing and development of the shutter 30 and the vehicle 10. Hence, in the case of the rapid increase in the ambient temperature, as described above, the controller 46 does not command immediate change to the position of the shutter 30. Instead, when the ambient temperature as sensed by the sensor 26 had increased rapidly across the predetermined temperature range, the time delay to change the position of the shutter 30 is instituted.

During operation of the vehicle 10, the temperature of the powertrain, and, in particular the temperature being sensed by the sensor 26, is monitored by the controller 46. When the controller 46 receives a signal from the sensor 26 that the temperature of the engine coolant has increased such that the position of the shutter 30 needs to be changed, any increase in the ambient temperature is also assessed. Accordingly, any change in the position of the shutter 30 is delayed by the predetermined amount of time in the event that the ambient temperature has increased across the predetermined temperature range. The position of the shutter 30 may be changed following the predetermined amount of time either by the controller 46 delaying generating a command to the mechanism 44, or by delaying a response by the mechanism, which for that purpose would include a processor unit (not shown). Such a processor unit may either be incorporated into the mechanism 44 or be a stand-alone device.

Figure 4:
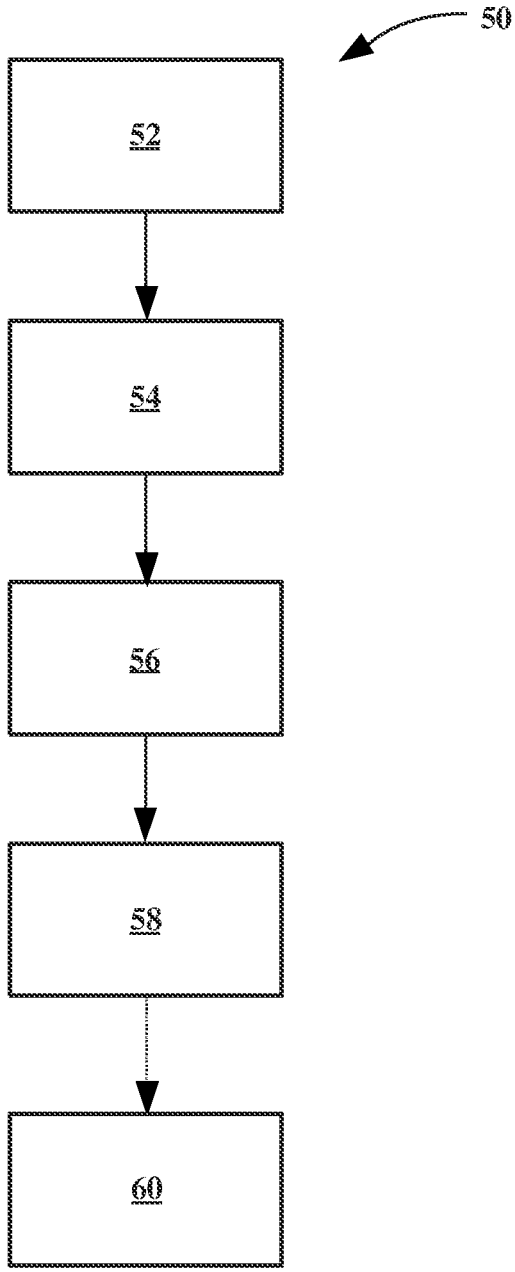
FIG. 4 is a flow chart illustrating a method controlling operation of the adjustable shutter depicted in FIGS. 1-3.

FIG. 4 depicts a method 50 controlling operation of the shutter 30, as described above with respect to FIGS. 1-3. The method commences in frame 52 and then proceeds to frame 54 where it includes monitoring the ambient temperature via the controller 46. Additionally, in frame 54 the controller 46 may regulate the mechanism 44 to select and lock the shutter 30 in a predetermined position which may include any of the positions shown in FIGS. 1-3, such as at or near freezing ambient temperatures. Following frame 54, the method advances to frame 56.

In frame 56, the method includes sensing an increase in the ambient temperature up to the threshold temperature value via the sensor 48. Following frame 56, the method proceeds to frame 58. In frame 58, the method includes changing the position of the shutter 30 after the predetermined amount of time has elapsed. As described with respect to FIGS. 1-3 above, the changing of the position of the shutter 30 after the predetermined amount of time has elapsed is accomplished following the increase in the ambient temperature up to the threshold temperature value.

Following frame 58, the method may advance to frame 60, where it includes monitoring the temperature of the powertrain of the vehicle 10, and in particular of the engine 14 as sensed by the sensor 26. According to the method, in frame 60 the change in the position of the shutter 30 may be requested in response to the increase in the temperature of the powertrain.

While the best modes for carrying out the invention have been described in detail, those familiar with the art to which this invention relates will recognize various alternative designs and embodiments for practicing the invention within the scope of the appended claims.

The invention claimed is:

1. A method of controlling operation of an adjustable shutter adapted for varying an amount of airflow to cool a powertrain in a vehicle, the method comprising:

monitoring the ambient temperature;

sensing an increase in the ambient temperature from below the freezing point of water up to a threshold temperature value that is above the freezing point; and changing a position of the shutter after a predetermined amount of time has elapsed following the increase in the ambient temperature up to the threshold temperature value, wherein the predetermined amount of time is indicative of an amount of time needed to thaw ice on the shutter.

2. The method of claim 1, further comprising monitoring a temperature of the powertrain, wherein said requesting the change in the position of the shutter is additionally accomplished in response to an increase in the temperature of the powertrain.

3. The method of claim 2, wherein each of said monitoring the ambient temperature, sensing the increase in the ambient temperature, changing the position of the shutter after the predetermined amount of time, and monitoring the temperature of the powertrain is accomplished by a controller.

4. The method of claim 3, the shutter including a mechanism configured to select the position of the shutter between and inclusive of the fully opened and the fully closed positions in response to a command from the controller, wherein said changing the position of the shutter after the predetermined amount of time is accomplished by one of delaying a command from the controller to the mechanism and delaying a response by the mechanism.

5. The method of claim 4, wherein the powertrain includes an internal combustion engine and a fan adapted to draw the airflow through the shutter to cool the engine, the method further comprising selectively turning the fan on and off and selecting the shutter positions between and inclusive of the fully-opened and the fully-closed by the controller according to a load on the engine.

6. The method of claim 5, wherein the vehicle includes a heat exchanger and a fluid circulated through the heat exchanger such that the engine is cooled by the fluid, and a sensor configured to sense a temperature of the fluid, the method further comprising cooling the engine by the fluid and sensing the temperature of the fluid by the sensor.

7. The method of claim 6, further comprising selecting the shutter position between and inclusive of the fully-opened and the fully-closed by the controller according to the sensed temperature of the fluid.

8. The method of claim 1, further comprising monitoring the ambient temperature and selecting and locking a predetermined position for the shutter in response to the ambient temperature being below a predetermined value.

9. The method of claim 1, wherein the shutter is arranged one of integral to the grille opening and adjacent to the grille opening.

* * * * *